United States Patent [19]

Properzi

[11] 4,079,608

[45] Mar. 21, 1978

[54] MULTI-STAND ROLLING MILL WITH AN OVERLOAD PROTECTION DEVICE

[76] Inventor: Giulio Properzi, Via Pietro Cossa, 1, Milan, Italy

[21] Appl. No.: 766,291

[22] Filed: Feb. 7, 1977

[30] Foreign Application Priority Data

Feb. 19, 1976 Italy ..... 20326 A/76

[51] Int. Cl.[2] ..... B21B 33/00

[52] U.S. Cl. ..... 72/5; 72/10; 72/249

[58] Field of Search ..... 72/3, 4, 5, 10, 19, 72/249, 250; 192/56 R, 150, 125 A

[56] References Cited

U.S. PATENT DOCUMENTS

| | | | |
|---|---|---|---|
| 150,516 | 5/1874 | Briggs et al. | 72/249 |
| 3,831,410 | 8/1974 | Properyl | 72/5 |

*Primary Examiner*—Milton S. Mehr
*Attorney, Agent, or Firm*—Guido Modiano; Albert Josif

[57] ABSTRACT

Multi-stand rolling mill with a device for protection against overloads due to irregularities in the feed of the rolled product, comprising a kinematic chain for transmitting motion to the stands from at least one drive means, with an individual drive shaft for each stand and a coupling between each of the drive shafts and the respective rolling stand. The couplings are electromagnetic couplings. Detector means are provided for detecting irregularities in the rolled product feed. The latter are associated with at least one of the stands, preferably the last and are operatively connected to at least one group of the couplings, and preferably all, to simultaneously operate the group of couplings, and preferably all the couplings, to cause all the rolling stands to be simultaneously disconnected from the kinematic chain.

2 Claims, 7 Drawing Figures

MULTI-STAND ROLLING MILL WITH AN OVERLOAD PROTECTION DEVICE

BACKGROUND OF THE INVENTION

This invenzion relates to a multi-stand rolling mill with a protection or safety device against overloads due in particular to irregularities in the feed of the rolled product.

In multi-stand rolling mills, for example for producing wire rod, the various rolling stands are driven mostly by a single drive motor through a kinematic chain, normally of gear type, each shaft of which drives one rolling stand, the various gears being calculated so as to give the rolls of each stand the correct predetermined speed relative to the rolls of the other stands.

Rolling mills of this type are very compact and also have the advantage that a single motor can drive more than twenty rolling stands.

However in these rolling mills disadvantages arise when irregularities occur in the wire rod feed, such as in the case of a fault in the coiler disposed downstream of the rolling mill for depositing the wire rod in the form of coil turns. In this case, the last rolling stand is no longer able to freely push out the wire rod obstructed downstream, so that this latter becomes axially loaded and begins to deform, bend and crowd up, remaining compressed between the mill rolls and the outlet guide of the rolling stand, to form cobbles.

Under these conditions, the rolls of the stand concerned become subjected to an increasing braking action by the amassed material, which leads not only to an increase in the forces on the drive shaft for the rolls of said stand, but can also damage the gauged surface of the rolls because of the rubbing which occurs between these latter and the rolled material.

To prevent an occurrence of this type, rolling mills have been devised in which protective pin joints of predetermined breakage load are interposed between the kinematic drive chain and each individual rolling stand. When an excessive increase in torque on the roll shaft occurs, as in the case of the formation of cobbles, the protective pin or pins break and the rolls of the stand in question therefore stop. However this stoppage of the stand where the cobble is formed does not completely solve the problem, but causes the phenomenon to be repeated in the stand immediately upstream, the rolls of which have remained in operation and continue to thrust out the rolled product. Thus the protective pin of this stand also breaks, and so on, until all the rolling stands stop due to breakage of their protective pins, when all the stands are blocked with material.

At this point, in order to return the arrested rolling mill to operation, the stands must firstly be completely dismantled to clean them of all the amassed material filling them, and then the broken protective pins must be replaced. It is often necessary to also replace the damaged outlet guides. All these operations lead to considerable wastage of time and correspondingly long shut-downs of the rolling mill, with serious production loss.

To avoid the chain-action breakage of the protective pins, it has also been proposed to stop the rolling mill drive motor or disengage the kinematic chain from the drive motor on formation of a cobble in one of the rolling stands. However such methods are not completely satisfactory, because due to the inertia of the kinematic chain (and motor) cobbles can still form in some of the other rolling stands, so likewise requiring cleaning of the stands.

SUMMARY OF THE INVENTION

The fundamental object of the present invention is to overcome the said disadvantages by providing a multi-stand rolling mill with an immediate protection device as heretofore specified, which enables the damage caused by disturbances in the rolled material feed to be effectively prevented, and also allows rapid re-activation of the entire rolling mill once the cause of the feed disturbances is removed, without it being necessary to replace any broken joints, with evident advantage for the rolling mill production.

A further object of the present invention is to provide a rolling mill with a protection device of simple structure, easily applicable to rolling mills already operating.

These and other objects, which will be more evident from the description given hereinafter, are attained by a multi-stand rolling mill with a device for protection against overloads due in particular to irregularities in the feed of the rolled product, comprising a kinematic chain for transmitting motion to said stands from at least one drive means, with an individual drive shaft for each stand and a coupling between each of said drive shafts and the respective rolling stand, characterized in that said couplings are electromagnetic couplings, and detector means are provided for detecting irregularities in the rolled product feed, associated with at least one of said stands, preferably the last, said detector means being operatively connected to at least one group of said couplings, and preferably all, to simultaneously operate said group of couplings, and preferably all the couplings, to cause all the rolling stands to be simultaneously disconnected from the kinematic chain.

In a rolling mill of this type, the main advantage is in the timeliness of the operation of the protection members and the fact that the integrity of these members is maintained, which on the one hand enables the phenomenon of cobble formation or other similar phenomena to be arrested at birth, and on the other hand enables the rolling mill to be rapidly re-started as no pieces have to be replaced, so considerably reducing rolling mill down-times. The operation of at least one group of couplings, and preferably all the couplings by a single detector means causing the rolls to be disconnected even where the irregularity has as yet not given rise to dangerous phenomena, prevents the propagation of the cobble formation phenomenon, and enables the subsequent checking and possible cleaning operations to be restricted to a single stand. The individual disconnection of the stands by the respective couplings prevents delays due to inertia, as would be the case if the kinematic chain or drive motor was halted. Means are obviously provided for interrupting the feed to the rolling mill once the various stands are stopped, these means being governed by the protection device according to the invention.

BRIEF DESCRIPTION OF THE DRAWINGS

Further characteristics and advantages of the invention will be more evident from the detailed description given hereinafter by way of example of some preferred but not exclusive embodiments of the invention, illustrated in the accompanying drawings in which.

DESCRIPTION OF THE PREFERRED EMBODIMENTS

Figure 1:
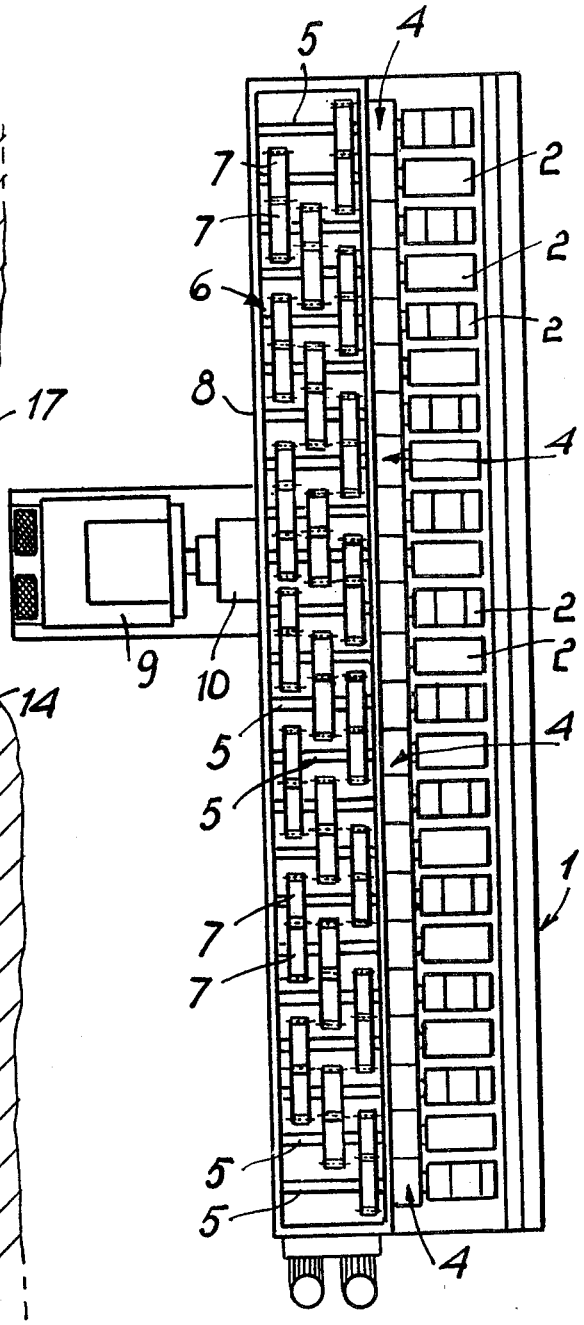
FIG. 1 is a diagrammatic view from above of a multi-stand rolling mill according to the invention.

With reference to FIG. 1, the rolling mill uder examination comprises in known manner a bed 1 on which the various rolling stands or groups 2 are disposed in succession, their shafts 3 (FIG. 2) being connected by couplings 4 to respective drive shafts 5 of the kinematic chain, indicated overall by 6. The gears 7 of the kinematic chain are disposed on the various drive shafts 5, and are calculated in such a manner as to give the rolls of the various rolling stands 2 the predetermined speeds, which gradually increase passing from the first stand, (at the bottom of the figure) to the last stand (at the top of the figure). The gears 7 and the shafts 5 are enclosed in an oiltight box 8. A single electric motor 9 is provided for driving the kinematic chain 6, and rotates one of the drive shafts 5 via a mechanical coupling 10.

Figure 2:
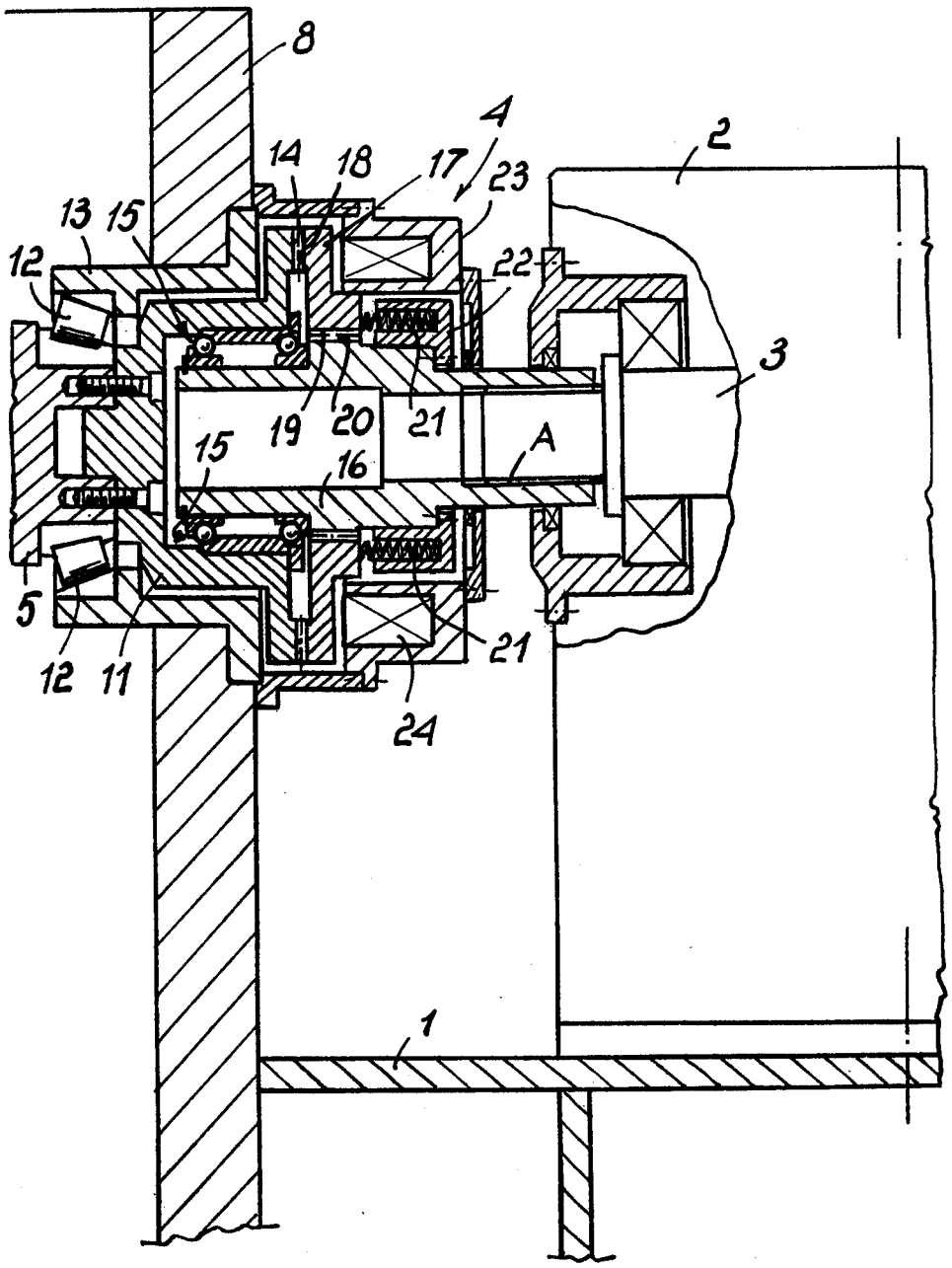
FIG. 2 is an axial section through a coupling according to the invention.

According to the invention, the couplings 4 disposed between each drive shaft 5 and its respective stand 2 are of the electromagnetic type and are constructed preferably as shown in FIG. 2.

Each coupling 4 comprises a substantially cap-like element 11 fixed to the end of the drive shaft 5, which is supported via bearings 12 in a support sleeve 13 rigid with the kinematic transmission box 8.

The cap element 11 comprises frontal toothing 14, and its interior houses, via bearings 15, the hub 16 which is rotatably connected by a coupling A to the end of the drive shaft 3 of the mill rolls (not shown). The bearings 15 provide axial and radial positioning for the hub 16 inside the cap element 11.

Between the cap element 11 and the hub 16 there is disposed the mobile element 17 of the coupling, which is configured substantially in the form of a disc and comprises frontal toothing 18 for engagement with the frontal toothing 14 of the cup element 11, and axial toothing 19 engaged with corresponding axial toothing 20 of the hub 16. In this manner the element 17 may slide axially on the hub 16, while remaining rotatably connected thereto. A series of springs 21, housed in a support member 22 rigid with the hub 16, tend to keep the mobile element 17 in the engaged position shown in FIG. 2. The element 17 is constructed of a ferromagnetic material or another material sensitive to a magnetic field.

In the cover 23, supported in a fixed manner by the box 8, there is housed the coil 24 of the electromagnet, connected electrically to the means for detecting feed irregularities, and which will be described hereinafter. More than one coil may obviously be provided for each coupling.

In the position shown in FIG. 2, in which the frontal toothing 28 of the mobile element 17 is engaged with the frontal toothing 14 of the cap element 11, motion is transmitted from the drive shaft 5 to the drive shaft 3 for the mill rolls. Should an irregularity occur in the feed, and be detected as will be described hereinafter, the coil (or coils) 24 is energised, so that the mobile element 17 becomes attracted towards the right in FIG. 2, disengaging from the cap element 11 and thus instantaneously interrupting the connection between the shaft 5 and the shaft 3. The rolling assembly therefore stops by inertia, dispersing the stored kinetic energy by rolling. This represents the minimum possible as the assembly is disconnected from the kinematic transmission 6, and thus the stopping time becomes the shortest possible, with the formation of cobbles being interrupted at birth.

Once the cause of the feed irregularity is removed, operating conditions are restored by opening the circuit energising the electromagnet, which can be done automatically by the detector means, and thus the mobile element 17, no longer attracted by the electromagnet and thrust by the spring 21, returns to its position of engagement with the cap 11 and the drive shaft 3 for the rolls is again driven.

Detector means of various types may be provided for controlling the various electromagnets associated with the rolling stands. In one particularly advantageous embodiment, detector means are associated with the outlet guide for the assemblies as shown in FIGS. 3 to 6. In this case, should any difficulty arise in feeding the rolled product, the material thrust forward by the rolls tends to bend at the outlet guide of a certain rolling assembly, to strike against the guide, and thus by arranging the detector means at the outlet guide an extremely rapid and thus particularly effective intervention is obtained.

Figure 3:
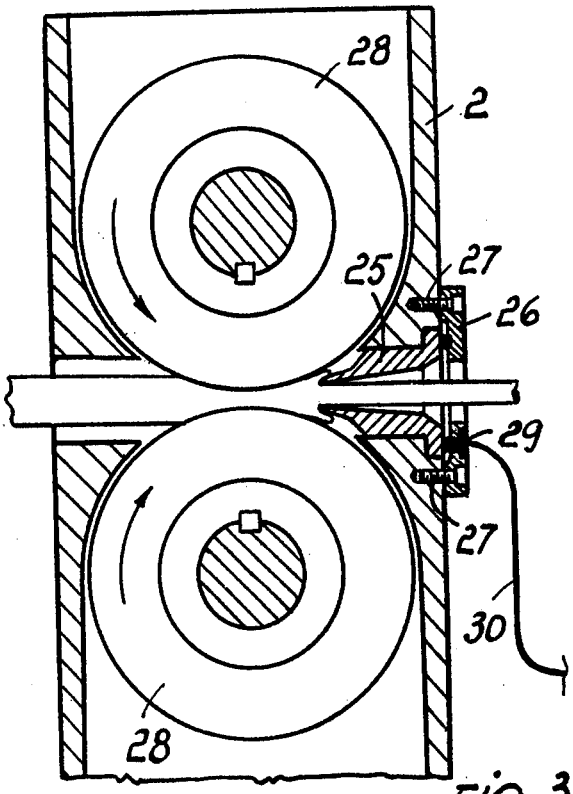
FIGS. 3 and 4 are a sectional elevation and front view respectively of one example of detector means fitted to the outlet of a rolling mill.
Figure 4:
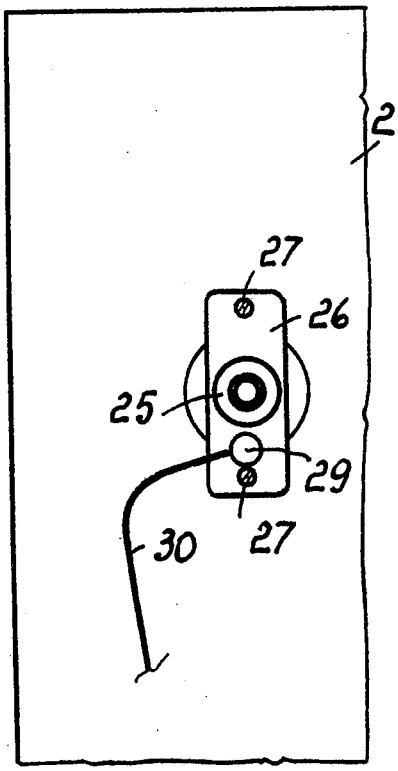

In the embodiment shown in FIGS. 3 and 4, the outlet guide 25 is held in position by a bracket 26 fixed to the structure of the rolling assembly 2 by screws 27. The mill rolls are indicated by 28. A load cell 29 is mounted between the bracket 26 and guide 25, and constitutes the actual detector means sensitive to the pressure exerted on it by the outlet guide 25, this pressure increasing as soon as a cobble occurs, as indicated diagrammatically in FIG. 3. The load cell 29 is sized to act when a predetermined pressure is reached by causing the current in the conductor 30 to undergo a variation which is used in known manner for closing the energising circuit of the electromagnet of one or more couplings 4, preferably all the couplings.

Figure 5:
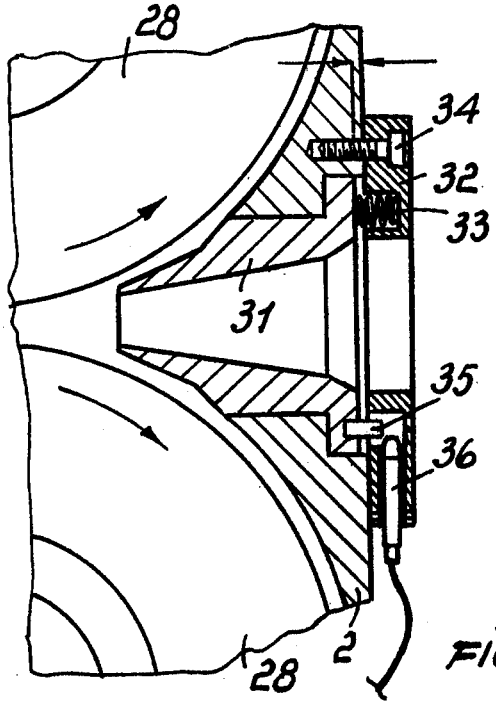
FIGS. 5 and 6 are a sectional elevation and front view respectively of another example of detector means fitted to the outlet of a rolling mill.
Figure 6:
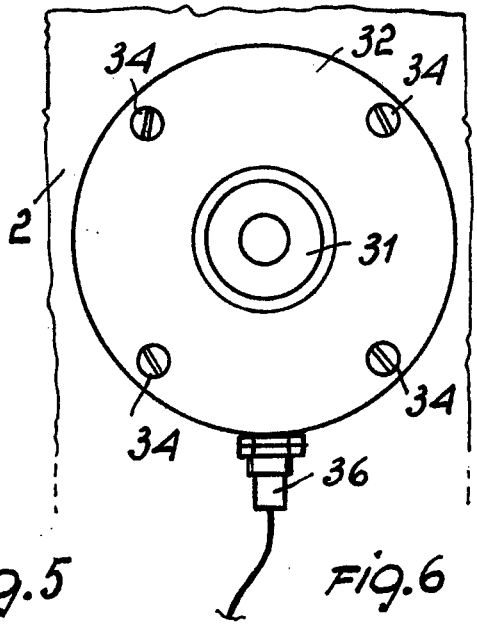

In the embodiment shown in FIGS. 5 and 6 the outlet guide 31 is held in position by a cover 32 by way of a series of springs 33 (only one of which is shown in FIG. 5), so that there is a certain gap between the guide and cover. The cover 32 is fixed to the structure of the rolling assembly 2 by screws 34. A pin 35 is rigid with the guide 31, while in the cover 32 in a position corresponding with the pin 35 there is disposed a proximity switch 36. When a cobble begins to form, the guide 31 is urged to move, under the pressure of the rolled material, against the action of the springs 33, also moving the pin 35 which is detected by the proximity switch 36 which thus causes closure of the energising circuit for the electromagnet of one or more couplings, preferably all the couplings. By varying the elastic constant of the springs 33 it is possible to vary the operating threshold of the device described. A normal limit switch may obviously be provided instead of the proximity switch 36.

Figure 7:
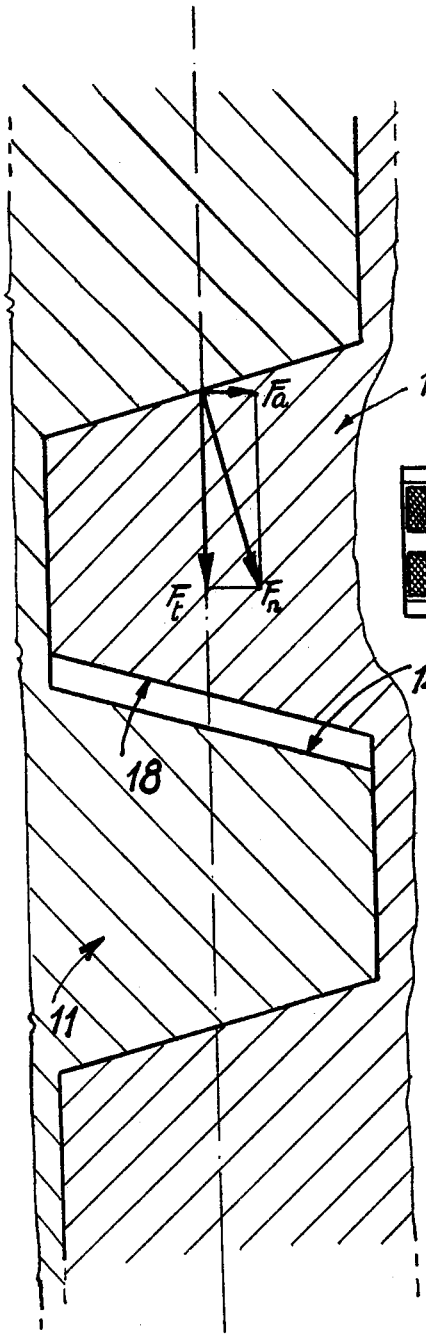
FIG. 7 shows to an enlarged scale a further detection system applicable to the rolling mill according to the invention.

Instead of utilising the pressure on the outlet guides, the energising circuit for the coupling electromagnets may be closed by utilising the greater force necessary for operating the mill rolls when the cobble forms. In a preferred embodiment, based on this concept, the frontal toothing 14 and 18 comprises trapezoidal teeth of inclined sides, with appropriate inclination as shown in FIG. 7. The trapezoidal shape, amongst other things, facilitates closure of the coupling and eliminates any slack between the cap element 11 and mobile element 17 with the coupling engaged. Because of the inclination of the teeth, the tangential force $F_t$ due to the twisting moment transmitted through the coupling gives rise to a force $F_n$ normal to the sides of the teeth, and an axial force $F_a$ which tends to separate the two toothings of the coupling. This latter force is balanced by the springs 21.

When the torque on the roll drive shaft 3 increases due to the formation of the cobble, the force $F_a$ also increases, and at a certain point overcomes the opposing action of the springs 21 to move the mobile element 17 substantially towards the right in FIG. 7, so withdrawing it from the cap element 11.

This movement may be detected by a limit switch disposed for example in the cover 23, this switch controlling in known manner at least the energising of the electromagnet of the rolling assembly under consideration, but preferably of all rolling assemblies.

The said movement may also be detected by causing an alternating current to circulate in the electromagnet coil, and of said a low value as not to give rise in practice to any appreciable attraction to the mobile element 17. When the mobile element 17 is urged to withdraw from the cap element 11 because of the overload on the coupling and the inclination of the toothing teeth, it approaches the electromagnet, and by changing the air gap between the mobile element 17 and the electromagnet, a change in impedance of the electromagnetic energising circuit is obtained, producing a current variation which can be utilized in known manner to increase the energization of the electromagnet and thus totally open the coupling.

Preferably all the rolling assemblies are provided with detector means, and all detector means are connected to the same control circuit so that any indication of an irregularity of feed in any one of the rolling assemblies leads to the simultaneous energising of all electromagnets, and thus the opening of all couplings, so as to prevent chain propagation of the cobble. It is also possible to construct a circuit to act on successive assemblies.

The invention described is susceptible to numerous modifications all of which fall within the scope of the inventive idea. Thus other types of detector means may be used, for example such as those described in U.S. Pat. No. 3,831,410 in the name of Ilario Properzi.

I claim

1. A multi-stand rolling mill including a device for protection against overloads due in particular to irregularities in the feed of the rolled product, comprising at least one drive means, a drive shaft for each stand, a kinematic chain for transmitting motion from said at least one drive means to each of said drive shafts, a coupling between each of said drive shafts and the respective rolling stand, and detector means provided for detecting irregularities in the rolled product feed and associated with at least the last of said stands, said detector means being operatively connected to at least one group of said couplings for simultaneously operating said at least one group of couplings to cause the rolling stands to be similtaneously disconnected from the kinematic chain. wherein said couplings are electromagnetic couplings each comprising a substantially cap-like element fixed to a respective drive shaft and provided with frontal toothing, a substantially disc-like mobile element provided with frontal toothing for engagement with said frontal toothing of said cap-like element and made of a material sensitive to a magnetic field, said mobile element being rotatably connected to the drive shaft of the rolls of the respective rolling stand and axially slidable relative to said drive shaft, at least one electromagnet controlled by said detector means for moving said mobile element and disengaging the teeth of said mobile element from said cap-like element, and elastic means for pressing said mobile element against said cap-like element.

2. A rolling mill as claimed in claim 1, wherein said frontal toothing of both said substantially cap-like element and said mobile element comprise teeth of trapezoidal profile, and said detector means are disposed to detect movements of said mobile element as a result of the overloading of the respective rolling stand.

* * * * *